US010688782B2

(12) United States Patent
Tomita et al.

(10) Patent No.: US 10,688,782 B2
(45) Date of Patent: Jun. 23, 2020

(54) LIQUID JET HEAD AND LIQUID JET RECORDING DEVICE

(71) Applicant: SII Printek Inc., Chiba-shi, Chiba (JP)

(72) Inventors: Naohiro Tomita, Chiba (JP); Yuki Yamamura, Chiba (JP); Masaru Midorikawa, Chiba (JP); Shuji Sato, Chiba (JP); Shunsuke Yamazaki, Chiba (JP)

(73) Assignee: SII PRINTEK INC., Chiba (JP)

( * ) Notice: Subject to any disclaimer, the term of this patent is extended or adjusted under 35 U.S.C. 154(b) by 0 days.

(21) Appl. No.: 16/181,653

(22) Filed: Nov. 6, 2018

(65) Prior Publication Data

US 2019/0134976 A1 May 9, 2019

(30) Foreign Application Priority Data

Nov. 7, 2017 (JP) ..... 2017-214865

(51) Int. Cl.
*B41J 2/04* (2006.01)
*B41J 2/045* (2006.01)
*B41J 2/14* (2006.01)

(52) U.S. Cl.
CPC ..... *B41J 2/04541* (2013.01); *B41J 2/04586* (2013.01); *B41J 2/1433* (2013.01); *B41J 2/14209* (2013.01); *B41J 2002/14362* (2013.01); *B41J 2002/14491* (2013.01); *B41J 2202/12* (2013.01)

(58) Field of Classification Search
None
See application file for complete search history.

(56) References Cited

U.S. PATENT DOCUMENTS

2005/0156981 A1 7/2005 Silverbrook et al.
2005/0157057 A1 7/2005 Silverbrook et al.
2009/0175676 A1* 7/2009 Ficyk ..... F16C 1/101 403/123
2016/0167382 A1* 6/2016 Date ..... B41J 2/04541 347/44

FOREIGN PATENT DOCUMENTS

JP 2009-001027 A 1/2009
JP 2016-155387 A 9/2016

OTHER PUBLICATIONS

Extended European Search Report for EP Application No. 18204802.5, dated Mar. 25, 2019, 13 pages.

* cited by examiner

*Primary Examiner* — Erica S Lin
(74) *Attorney, Agent, or Firm* — Brinks Gilson & Lione

(57) ABSTRACT

There are provided a liquid jet head and a liquid jet recording device capable of enhancing the reliability. A liquid jet head according to an embodiment of the disclosure includes a liquid jet section from which liquid is jetted, an electronic control section electrically connected to the liquid jet section, a main protective member adapted to cover a periphery of the electronic control section, a connection section attached to the electronic control section and adapted to electrically connect an outside of the liquid jet head and the electronic control section to each other, and a connection section protective member configured so as to make a state transition between a protection state of covering the connection section and an exposure state of exposing the connection section.

8 Claims, 8 Drawing Sheets

LIQUID JET HEAD AND LIQUID JET RECORDING DEVICE

RELATED APPLICATIONS

This application claims priority under 35 U.S.C. § 119 to Japanese Patent Application No. 2017-214865 filed Nov. 7, 2017, the entire content of which is hereby incorporated by reference.

BACKGROUND OF THE INVENTION

1. Field of the Invention

The present disclosure relates to a liquid jet head and a liquid jet recording device.

2. Description of the Related Art

As one of liquid jet recording devices, there is provided an inkjet type recording device for ejecting (jetting) ink (liquid) on a recording target medium such as recording paper to perform recording of images, characters, and so on.

In the liquid jet recording device of this type, it is arranged that the ink is supplied from an ink tank to an inkjet head (a liquid jet head), and then the ink is ejected from nozzle holes of the inkjet head toward the recording target medium to thereby perform recording of the images, the characters, and so on.

The liquid jet head is provided with an electronic control section for controlling ejection of the ink from the nozzle holes. The electronic control section is protected by, for example, a cover (see, e.g., JP-A-2009-1027).

In such a liquid jet head or the like, it is required to prevent a failure on the periphery of the electronic control section, for example, from occurring to enhance the reliability. Therefore, it is desirable to provide a liquid jet head and a liquid jet recording device capable of enhancing the reliability.

SUMMARY OF THE INVENTION

A liquid jet head according to an embodiment of the disclosure includes a liquid jet section from which a liquid is jetted, an electronic control section electrically connected to the liquid jet section, a main protective member adapted to cover a periphery of the electronic control section, a connection section attached to the electronic control section and adapted to electrically connect an outside of the liquid jet head and the electronic control section to each other, and a connection section protective member configured so as to make a state transition between a protection state of covering the connection section and an exposure state of exposing the connection section.

A liquid jet recording device according to an embodiment of the disclosure is equipped with the liquid jet head according to an embodiment of the disclosure.

According to the liquid jet head and the liquid jet recording device related to an embodiment of the disclosure, it becomes possible to enhance the reliability.

DETAILED DESCRIPTION OF THE PREFERRED EMBODIMENTS

An embodiment of the present disclosure will hereinafter be described in detail with reference to the drawings.

1. Embodiment

[Overall Configuration of Printer 1]

Figure 1:
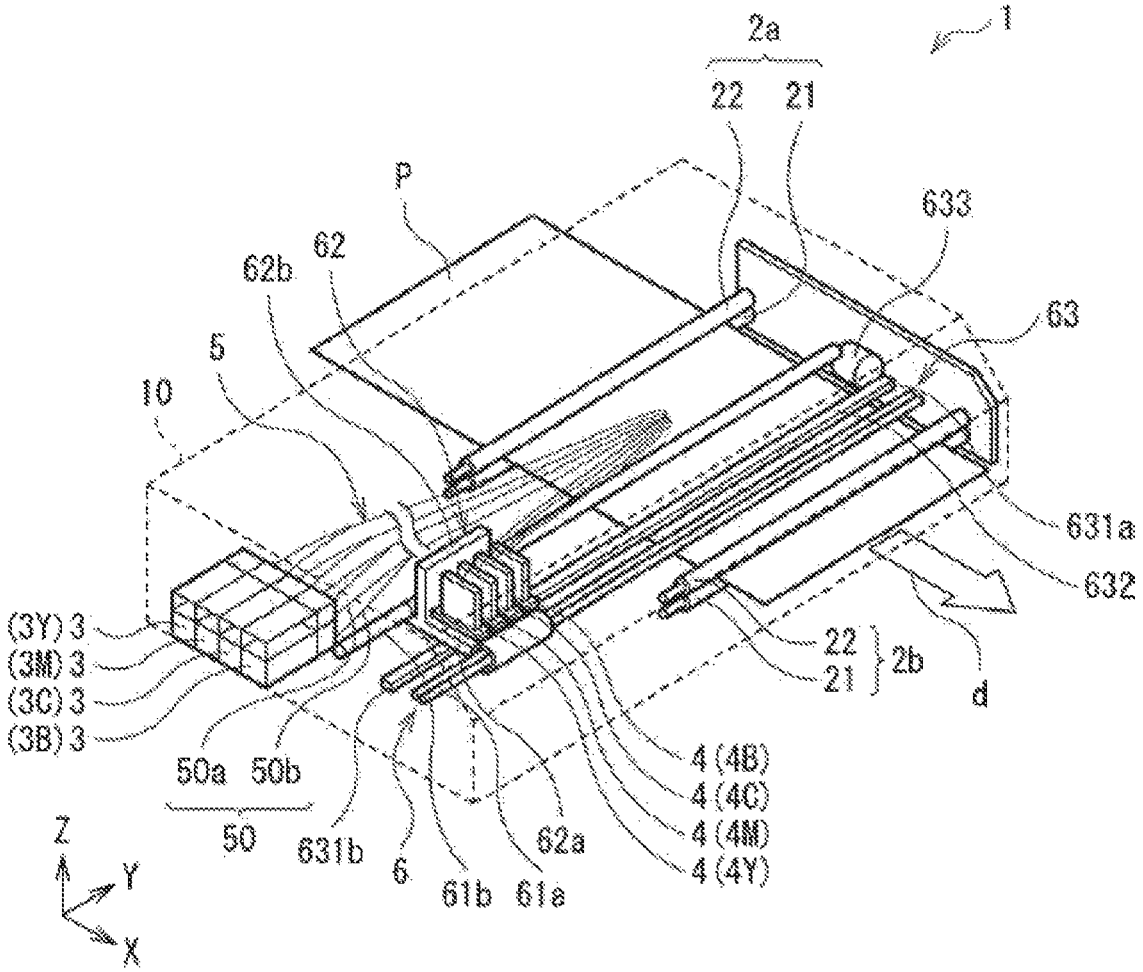
FIG. 1 is a schematic perspective view showing a schematic configuration example of a liquid jet recording device according to an embodiment of the disclosure.

FIG. 1 is a perspective view schematically showing a schematic configuration example of a printer 1 as a liquid jet recording device according to one embodiment of the present disclosure. The printer 1 is an inkjet printer for performing recording (printing) of images, characters, and so on, on recording paper P as a recording target medium using ink 9 described later.

As shown in FIG. 1, the printer 1 is provided with a pair of carrying mechanisms 2*a*, 2*b*, ink tanks 3, inkjet heads 4, a circulation mechanism 5, and a scanning mechanism 6. These members are housed in a housing 10 having a predetermined shape. It should be noted that the scale size of each member is accordingly altered so that the member is shown large enough to recognize in the drawings used in the description of the specification.

Here, the printer 1 corresponds to a specific example of the "liquid jet recording device" in the present disclosure, and the inkjet heads 4 (the inkjet heads 4Y, 4M, 4C, and 4B described later) each correspond to a specific example of the "liquid jet head" in the present disclosure. Further, the ink 9 corresponds to a specific example of the "liquid" in the present disclosure.

The carrying mechanisms 2*a*, 2*b* are each a mechanism for carrying the recording paper P along the carrying direction d (an X-axis direction) as shown in FIG. 1. These carrying mechanisms 2*a*, 2*b* each have a grit roller 21, a pinch roller 22 and a drive mechanism (not shown). The grit roller 21 and the pinch roller 22 are each disposed so as to extend along a Y-axis direction (the width direction of the recording paper P). The drive mechanism is a mechanism for rotating (rotating in a Z-X plane) the grit roller 21 around an axis, and is constituted by, for example, a motor.

(Ink Tanks 3)

The ink tanks 3 are each a tank for containing the ink 9 inside. As the ink tanks 3, there are disposed 4 types of tanks for individually containing 4 colors of ink 9, namely yellow (Y), magenta (M), cyan (C), and black (B), in this example as shown in FIG. 1. Specifically, there are disposed the ink tank 3Y for containing the yellow ink 9, the ink tank 3M for containing the magenta ink 9, the ink tank 3C for containing the cyan ink 9, and the ink tank 3B for containing the black ink 9. These ink tanks 3Y, 3M, 3C, and 3B are arranged side by side along the X-axis direction inside the housing 10.

It should be noted that the ink tanks 3Y, 3M, 3C, and 3B have the same configuration except the color of the ink 9 contained, and are therefore collectively referred to as ink tanks 3 in the following description.

(Inkjet Heads 4)

The inkjet heads 4 are each a head for jetting (ejecting) the ink 9 having a droplet shape from a plurality of nozzles (nozzle holes H1) described later to the recording paper P to thereby perform printing of images, characters, and so on. As the inkjet heads 4, there are also disposed 4 types of heads for individually jetting the 4 colors of ink 9 respectively contained by the ink tanks 3Y, 3M, 3C, and 3B described above in this example as shown in FIG. 1. Specifically, there are disposed the inkjet head 4Y for jetting the yellow ink 9, the inkjet head 4M for jetting the magenta ink 9, the inkjet head 4C for jetting the cyan ink 9, and the inkjet head 4B for jetting the black ink 9. These inkjet heads 4Y, 4M, 4C, and 4B are arranged side by side along the Y-axis direction inside the housing 10.

Figure 2:
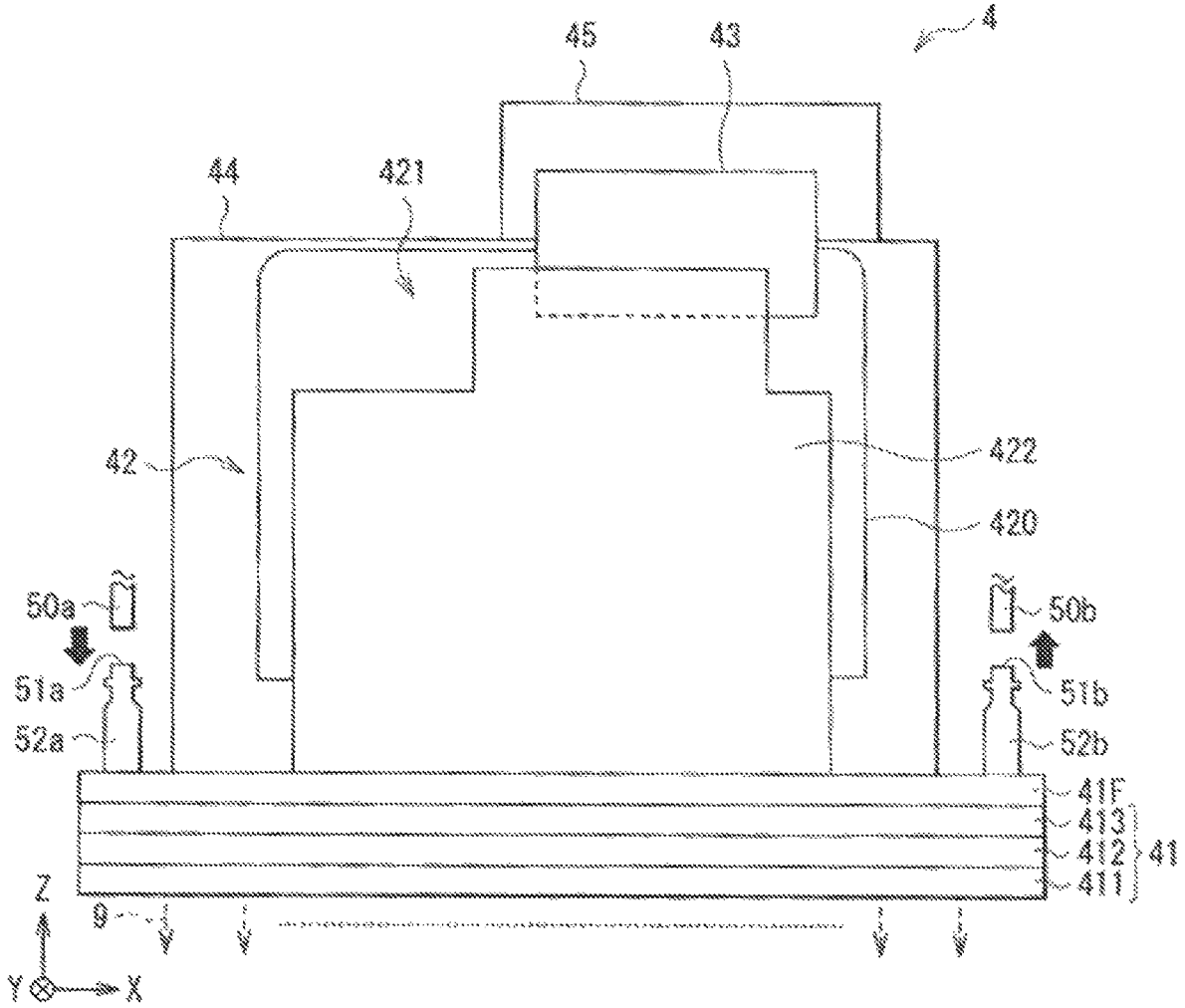
FIG. 2 is a schematic side view showing a detailed configuration example of the liquid jet head shown in FIG. 1.

It should be noted that the inkjet heads 4Y, 4M, 4C, and 4B have the same configuration except the color of the ink 9 used, and are therefore collectively referred to as inkjet heads 4 in the following description. Further, the detailed configuration of the inkjet heads 4 will be described later in detail (FIG. 2).

(Circulation Mechanism 5)

The circulation mechanism 5 is a mechanism for circulating the ink 9 between the inside of the ink tanks 3 and the inside of the inkjet heads 4. The circulation mechanism 5 is configured including, for example, circulation channels 50 as flow channels for circulating the ink 9, and pairs of liquid feeding pumps (not shown).

As shown in FIG. 1, the circulation channels 50 each have, for example, a flow channel 50*a* as a part extending from the ink tank 3 to the inkjet head 4, and a flow channel 50*b* extending from the inkjet head 4 to the ink tank 3. In other words, the flow channel 50*a* is a flow channel through which the ink 9 flows from the ink tank 3 toward the inkjet head 4. Further, the flow channel 50*b* is a flow channel through which the ink 9 flows from the inkjet head 4 toward the ink tank 3. It should be noted that these flow channels 50*a*, 50*b* (supply tubes of the ink 9) are each formed of a flexible hose having flexibility.

(Scanning Mechanism 6)

The scanning mechanism 6 is a mechanism for making the inkjet heads 4 perform a scanning operation along the width direction (the Y-axis direction) of the recording paper P. As shown in FIG. 1, the scanning mechanism 6 has a pair of guide rails 61*a*, 61*b* disposed so as to extend along the Y-axis direction, a carriage 62 movably supported by these guide rails 61*a*, 61*b*, and a drive mechanism 63 for moving the carriage 62 along the Y-axis direction. Further, the drive mechanism 63 is provided with a pair of pulleys 631*a*, 631*b* disposed between the pair of guide rails 61*a*, 61*b*, an endless belt 632 wound between the pair of pulleys 631*a*, 631*b*, and a drive motor 633 for rotationally driving the pulley 631*a*.

The pulleys 631*a*, 631*b* are respectively disposed in areas corresponding to the vicinities of both ends in each of the guide rails 61*a*, 61*b*. To the endless belt 632, there is connected the carriage 62. The carriage 62 has a pedestal 62*a* having a plate-like shape for mounting the four types of inkjet heads 4Y, 4M, 4C, and 4B described above, and a wall section 62*b* erected vertically (in the Z-axis direction) from the pedestal 62*a*. On the pedestal 62*a*, the inkjet heads 4Y, 4M, 4C, and 4B are arranged side by side along the Y-axis direction.

It should be noted that it is arranged that a moving mechanism for moving the inkjet heads 4 relatively to the recording paper P is constituted by such a scanning mechanism 6 and the carrying mechanisms 2*a*, 2*b* described above.

[Detailed Configuration of Inkjet Heads 4]

Then, the detailed configuration example of the inkjet heads 4 will be described with reference to FIG. 2 in addition to FIG. 1. FIG. 2 is a side view (a Z-X side view) schematically showing the detailed configuration example of the inkjet head 4.

The inkjet heads 4 according to the present embodiment are each, for example, an inkjet head of a so-called side-shoot type for ejecting the ink 9 from a central part in the extending direction (the Y-axis direction) of a plurality of channels (channels C1) described later. Further, the inkjet heads 4 are each an inkjet head of a circulation type which uses the circulation mechanism 5 (the circulation channel 50) described above to thereby use the ink 9 while circulating the ink 9 between the inkjet head 4 and the ink tank 3. The inkjet head 4 is provided with an introduction opening 51*a* and a discharge opening 51*b* of the ink 9. The introduction opening 51*a* is an entrance of the ink 9 to the inkjet head 4, and is provided to an introduction port 52*a* of the inkjet head 4. The introduction port 52*a* is connected to a flow channel 41FP (described later) of a flow channel plate 41F. The discharge opening 51*b* is an exit of the ink 9 from the inkjet head 4, and is provided to a discharge port 52*b* of the inkjet head 4. The introduction port 52*a* and the discharge port 52*b* are connected to the flow channel 41FP (described later) of the flow channel plate 41F.

The inkjet head 4 is provided with a head chip 41, the flow channel plate 41F, an electronic control section 42, a connection section 43, a cover 44 and a connection section cover 45 together with the introduction part 52*a* and the discharge port 52*b*.

Figure 6:
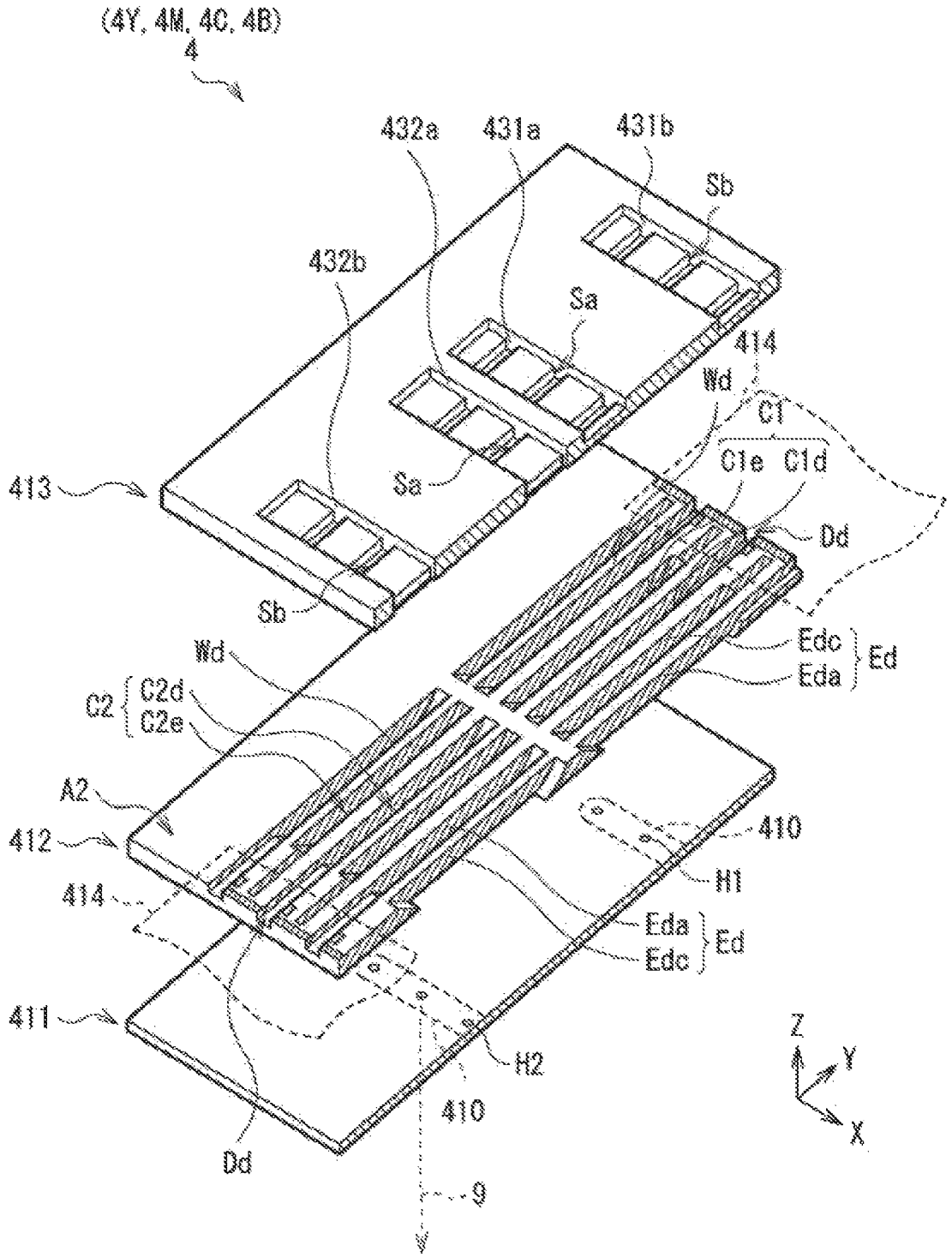
FIG. 6 is a perspective view showing respective configurations of the nozzle plate, the actuator plate, and the cover plate shown in FIG. 2.
Figure 7:
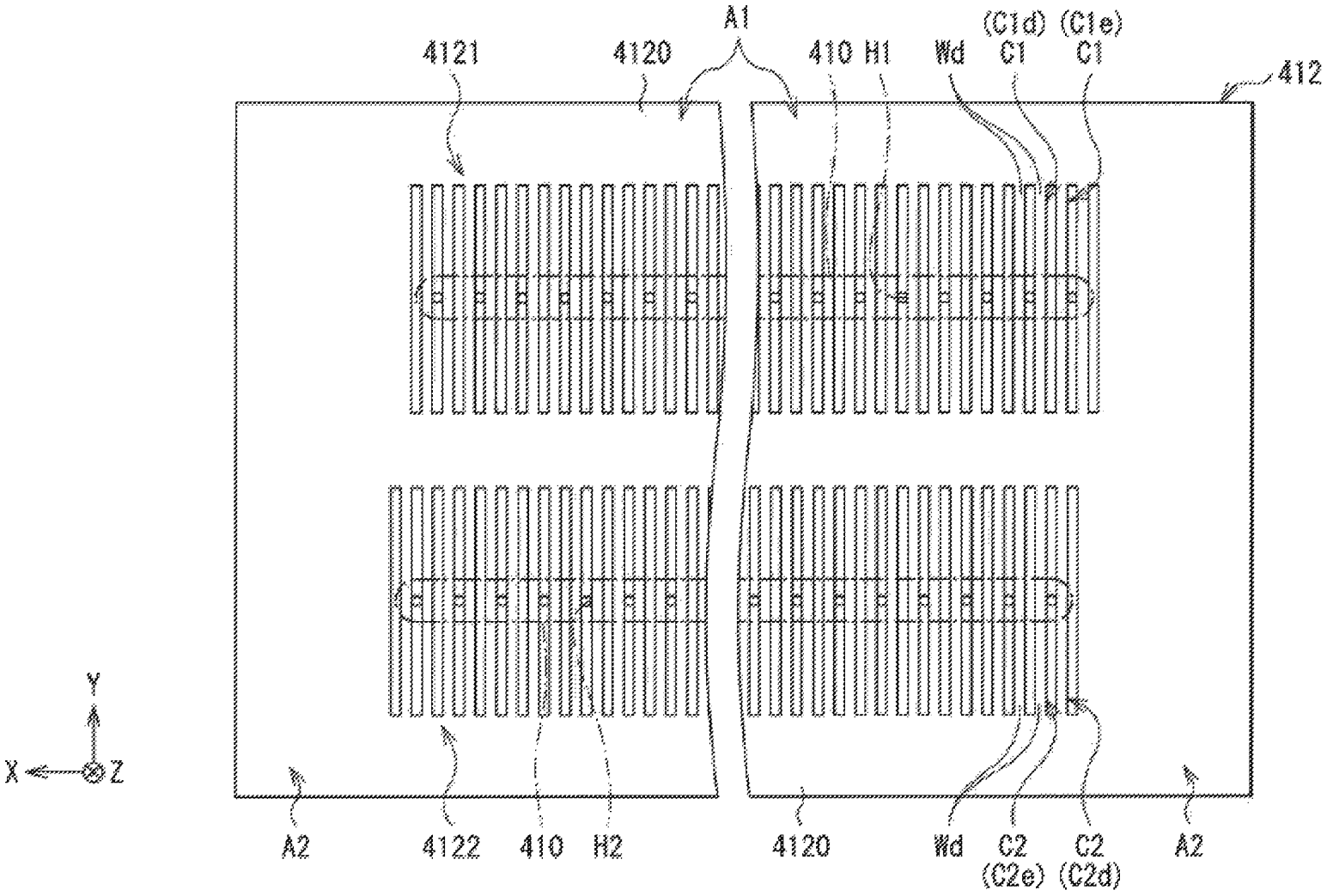
FIG. 7 is a plan view showing a configuration of the actuator plate shown in FIG. 6.
Figure 8:
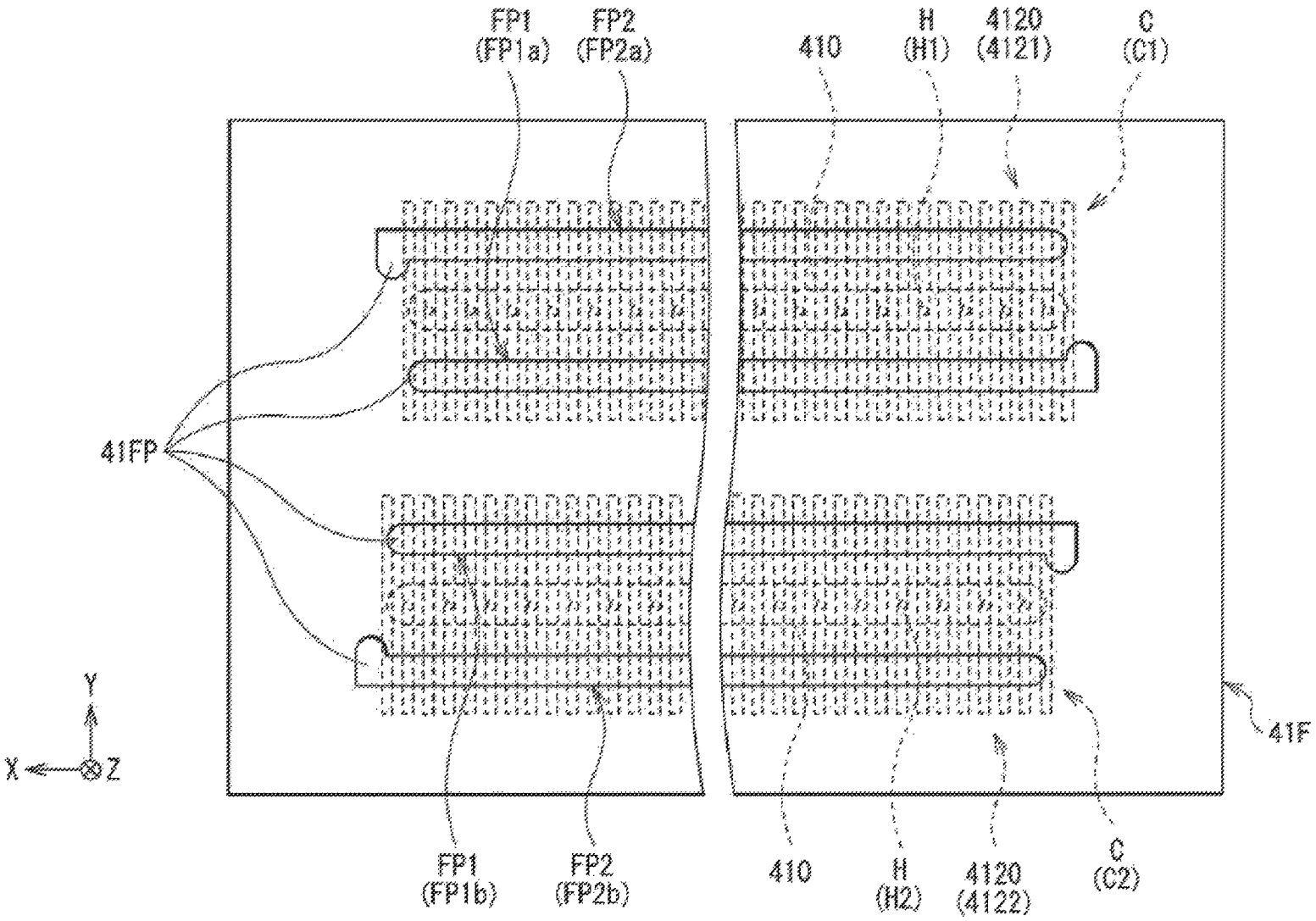
FIG. 8 is a plan view showing a configuration of the flow channel plate shown in FIG. 2.

The head chip 41 and the flow channel plate 41F are a member for jetting the ink 9 along the Z-axis direction, and are configured using a variety of types of plates described later. It should be noted that the head chip 41 and the flow channel plate 41F correspond to a specific example of a "liquid jet section" in the present disclosure, and the detailed configuration of the head chip 41 and the flow channel plate 41F will be described later (FIG. 6 through FIG. 8).

(Electronic Control Section 42)

The electronic control section 42 has a circuit board 420 on which a drive circuit 421 is mounted, and a flexible board 422. The electronic control section 42 is for (driving the head chip 41) controlling an operation of the head chip 41.

The circuit board 420 is erected along a vertical direction (the Z-axis direction in this example) on the head chip 41. The drive circuit 421 is constituted by a circuit pattern provided to the circuit board 420. The drive circuit 421 is electrically connected to the head chip 41 (more specifically, an actuator plate 412 described later) via the flexible board 422.

One end of the flexible board 422 is connected to the head chip 41, and the other end is connected to the drive circuit 421. The flexible board 422 is provided with printed-wiring of a plurality of extraction electrodes, and the drive circuit 421 and the head chip 41 are electrically connected to each other with the extraction electrodes.

(Connection Section 43)

The connection section 43 is for electrically connecting the outside of the inkjet head 4 and the drive circuit 421 to each other, and is attached to the circuit board 420. The connection section 43 is formed of, for example, an interface connector. The connection section 43 is arranged to be connected to a cable (an electric cable 47 shown in FIG. 3 described later) connected to, for example, a signal board of the printer 1 via a connector on the cable side. The connection section 43 is dispose in, for example, the vicinity of an upper end (an end with the largest distance from the head chip 41 in the Z-axis direction in this example) of the circuit board 420 so as to protrude from the circuit board 420. It is preferable for the connection section 43 to be disposed at a higher level (at a higher position than the flow channel plate 41F in the vertical direction) than the introduction opening 51*a* of the ink 9 to the inkjet head 4 provided to the circulation channel 50. In other words, it is preferable for the introduction opening 51*a* to be disposed at a lower level than the connection section 43. Thus, it is possible to prevent the ink 9 from adhering to the connection section 43 from the introduction opening 51*a*.

(Cover 44)

The cover 44 is disposed on the flow channel plate 41F to cover the periphery of the electronic control section 42. For example, the cover 44 has a roughly rectangular solid box-like shape, and the electronic control section 42 is sealed in the cover 44 shaped like a box. The cover 44 is a member for preventing the ink 9 from adhering to the electronic control section 42. The upper surface of the cover 44 is provided with an opening part through which the connection section 43 is inserted, and the connection section 43 is disposed so as to protrude from the opening part to the outside of the cover 44. The cover 44 is formed of a material having resistance to the material of the ink 9. The cover 44 is formed of a resin material such as poly phenylene sulfide (PPS) or nylon, or a metal material. It should be noted that such a cover 44 corresponds to a specific example of a "protective member" in the present disclosure.

(Connection Section Cover 45)

The connection section cover 45 is for protecting the connection section 43 exposed from the cover 44, and is disposed on the cover 44. Although the details will be described later, in the present embodiment, since the inkjet head 4 is provided with the connection section cover 45, a failure due to the adhesion of the ink 9 to the connection section 43 can be prevented from occurring. Similarly to the cover 44, the connection section cover 45 is formed of a material having resistance to the material of the ink 9. The connection section cover 45 is formed of a resin material such as poly phenylene sulfide (PPS) or nylon, or a metal material. It is also possible to arrange that the connection section cover 45 is formed of the same material as that of the cover 44. It should be noted that such a connection section cover 45 corresponds to a specific example of a "connection section protective member" in the present disclosure.

Figure 3:
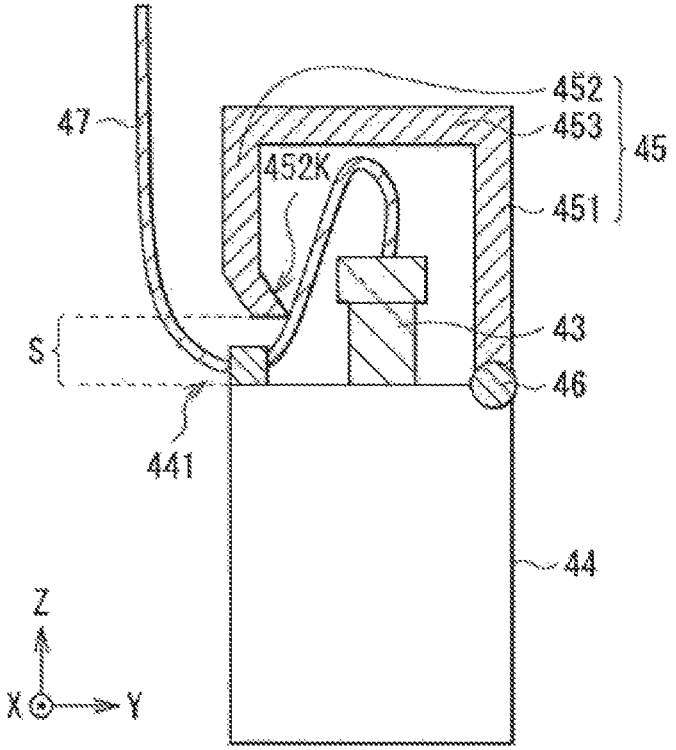
FIG. 3 is a schematic partial cross-sectional view showing a configuration example of the connection section, the cover and the connection section cover (in a protection state) shown in FIG. 2.

FIG. 3 shows a configuration of a cross-sectional surface (a Y-Z cross-sectional surface) of the connection section cover 45 together with a cross-sectional surface of the connection section 43 and a side surface of the cover 44. The connection section cover 45 includes a back plate 451 erected in the vertical direction on, for example, the cover 44, a front plate 452 opposed to the back plate across the connection section 43, and an upper plate 453 connecting an upper end of the front plate 452 and an upper end of the back plate 451 to each other. The connection section cover 45 is connected to the cover 44 with a hinge 46. By providing such a hinge 46, it becomes possible for the connection section cover 45 to make the state transition between a protection state of covering the connection section 43 and an exposure state of exposing the connection section 43 (described later).

The back plate 451 is disposed in parallel to a surface (a Z-X plane) of the circuit board 420, and a lower end of the back plate 451 has contact with the upper surface of the cover 44. The lower end of the back plate 451 is connected to the cover 44 with the hinge 46.

The front plate 452 is disposed in parallel to the back plate 451, and a lower end of the front plate 452 is disposed so as to form a gap S with the upper surface of the cover 44. The gap S is for inserting the electric cable (the electric cable 47), and it is arranged that the connection section 43 and the outside of the inkjet head 4 are connected to each other with the electric cable 47 passing through the gap S. By the electric cable 47 passing through the gap S between the lower end of the front plate 452 and the upper surface of the cover 44, the electric cable 47 extends upward (in the vertical direction) in the connection section cover 45. Thus, it is possible to prevent the ink 9 from running along the electric cable 47 to reach the connection section 43.

Further, in order to prevent the ink 9 from entering the inside of the connection section cover 45 via the gap S, it is preferable for a barb part 452K to be provided to the lower end of the front plate 452. The barb part 452K is disposed so as to be tilted toward the direction of approaching the back plate 451 so as to block the ink 9 spread from the gap S toward the connection section 43. In other words, the barb part 452K is a part tilted toward the connection section 43 of the front plate 452, and it is arranged that the ink 9 spread from obliquely below the gap S between the cover 44 and the front plate 452 collides with the barb part 452K before adhering to the connection section 43.

The upper plate 453 is disposed above the connection section 43 in parallel to, for example, the upper surface (an X-Y plane) of the cover 44. One end and the other end of the upper plate 453 each have contact with the upper end of the front plate 452 and the upper end of the back plate 451, and the back plate 451, the front plate 452 and the upper plate 453 are integrated with each other.

The connection section cover 45 formed of the back plate 451, the front plate 452 and the upper plate 453 integrated with each other is arranged to pivot about the hinge 46 to be able to make the state transition between the protection state of covering the connection section 43 and the exposure state of exposing the connection section 43. Thus, it is possible to easily switch to the protection state after setting the connection section cover 45 to the exposure state to connect the electric cable 47 to the connection section 43. Therefore, it is possible to easily connect the connection section 43 to the electric cable 47 without being hindered by the connection section cover 43.

In the protection state (FIG. 3), the back side, the front side and the upper side of the connection section 43 are covered with the back plate 451, the front plate 452 and the upper plate 453, respectively. On both of the lateral sides of the connection section 43, there are disposed side plates (not shown), and thus, all of the surfaces of a part of the connection section 43 exposed from the cover 44 are covered with the connection section cover 45. It is preferable for the connection section cover 45 to require force equal to or higher than a predetermined value for the pivotal motion about the hinge 46 so as not to be set to the exposure state without intention.

Figure 4:
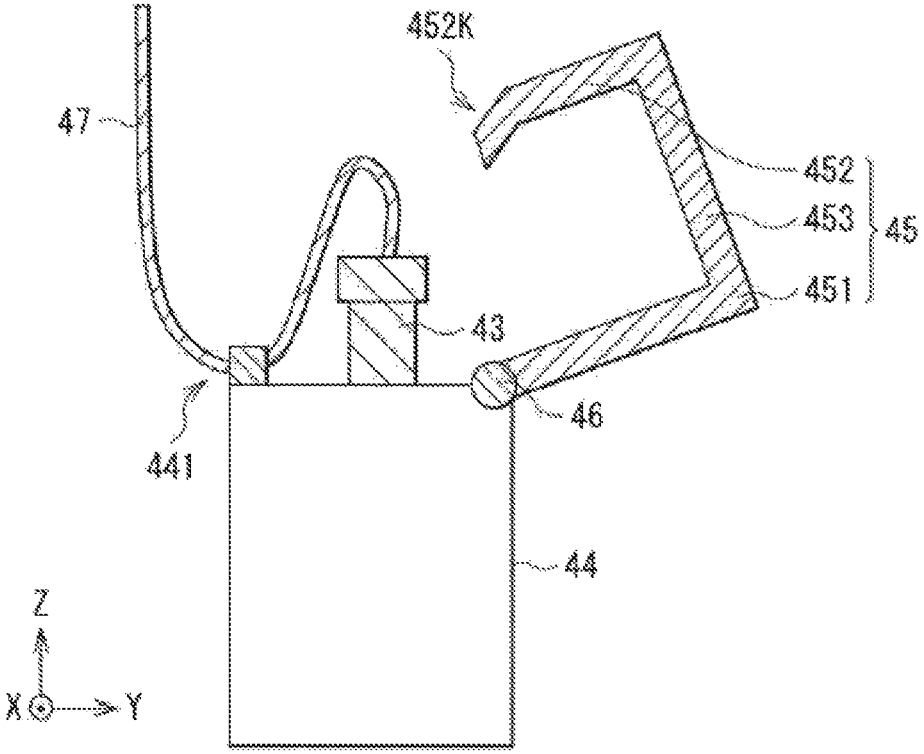
FIG. 4 is a schematic partial cross-sectional view showing an exposure state of the connection section cover shown in FIG. 3.

FIG. 4 shows the connection section cover 45 in the exposure state together with the connection section 43 and the cover 44. The connection section cover 45 pivoting about the hinge 46 moves to the back side of the connection section 43 (pivots clockwise in FIG. 3) to expose the front side and the upper side of the connection section 43. In the connection section cover 45 in the exposure state, it is sufficient for the connection section 43 to be exposed to the extent that the electric cable 47 can be attached to and detached from the connection section 43. In the exposure state, the electric cable 47 is connected to the connection section 43 from, for example, above the connection section 43.

(Holding Structure 441)

In the case in which the connection section cover 45 is in the protection state, the movement in the gap S of the electric cable 47 connected to the connection section 43 is limited by the holding structure 441. The holding structure 441 is disposed at, for example, a front end of the upper surface of the cover 44, namely in the gap S, and is integrated with the cover 44.

Figure 5:
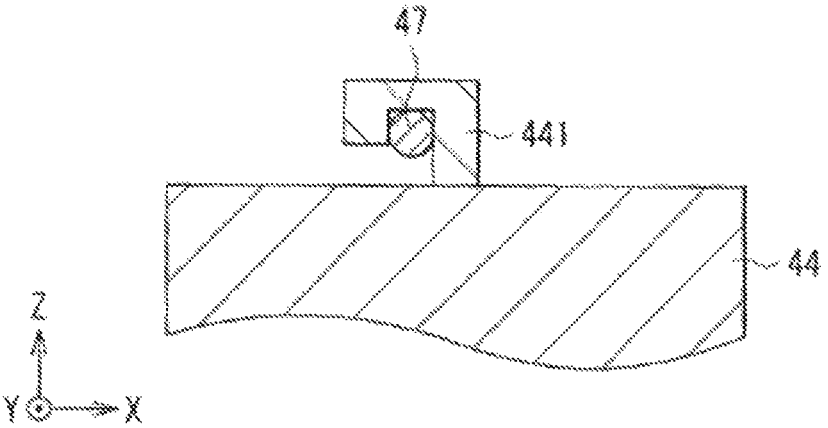
FIG. 5 is a schematic cross-sectional view showing an example of a configuration of the holding structure shown in FIG. 3.

FIG. 5 is a diagram showing a configuration of a cross-sectional surface (an X-Z cross-sectional surface) of the holding structure 441 together with the electric cable 47. The holding structure 441 has, for example, a hook-like shape, and projects on the upper surface of the cover 44. In the protection state, the electric cable 47 is hooked by the holding structure 441 having the hook-like shape, and thus the movement in the upward direction (the Z-axis direction) of the electric cable 47 is limited. Therefore, even if force is applied to the electric cable 47, the electric cable 47 is prevented from having contact with the connection section cover 45 in the protection state, and therefore, it is possible to prevent the connection section cover 45 from being unintentionally set to the exposure state. In other words, by providing the holding structure 441, it is possible to prevent the connection section cover 45 from unintentionally set to the exposure state even in the case in which the force for keeping the protection state of the connection section cover 45 is rather weak. Although it is also possible to provide the holding structure 441 separately from the cover 44, the movement of the electric cable 47 can more effectively be suppressed by providing the holding structure 441 so as to be integrated with the cover 44.

Further, the electric cable 47 passing through the gap S extends upward (in the vertical direction) in the connection section cover 45 as described above. By providing the holding structure 441, it becomes easy to keep the state of the electric cable 47 extending upward. Therefore, it is possible to more effectively prevent the ink 9 from running along the electric cable 47 to reach the connection section 43.

[Detailed Configuration of Head Chip 41 and Flow Channel Plate 41F]

Then, a detailed configuration example of the head chip 41 and the flow channel plate 41F will be described with reference to FIG. 6 through FIG. 8, in addition to FIG. 2.

(Head Chip 41)

The head chip 41 is a member for jetting the ink 9 along the Z-axis direction, and is configured using a variety of types of plates described below.

FIG. 6 is an exploded perspective view of the head chip 41 shown in FIG. 2, and FIG. 7 is a bottom view (an X-Y bottom view) schematically showing a configuration example of the inkjet head 4 in the state in which a nozzle plate 411 (described later) shown in FIG. 6 is detached. The head chip 41 is mainly provided with the nozzle plate (a jet hole plate) 411, an actuator plate 412 and a cover plate 413. The head chip 41 is stacked on the flow channel plate 41F, and the nozzle plate 411, the actuator plate 412 and the cover plate 413 are arranged in this order with the nozzle plate 411 being the farthest from the flow channel plate 41F. The nozzle plate 411, the actuator plate 412 and the cover plate 413 are bonded to each other using, for example, an adhesive, and are stacked on one another in this order along the Z-axis direction.

(Nozzle Plate 411)

The nozzle plate 411 is formed of, for example, a metal material, and has a thickness of about 50 μm. As shown in FIG. 6, the nozzle plate 411 is bonded to a lower surface of the actuator plate 412 with an adhesive layer (not shown). Further, as shown in FIG. 6, the nozzle plate 411 is provided with two nozzle columns 410 each extending along the X-axis direction. The two nozzle columns 410 are arranged along the Y-axis direction at a predetermined distance. As described above, the inkjet head 4 of the present embodiment is formed as a tow-column type inkjet head.

One of the nozzle columns 410 has a plurality of nozzle holes H1 formed in alignment with each other at predetermined intervals along the X-axis direction. These nozzle holes H1 each penetrate the nozzle plate 411 along the thickness direction (the Z-axis direction) of the nozzle plate 411, and are communicated with, for example, the respective ejection channels C1*e* in the actuator plate 412 described later. Specifically, as shown in FIG. 6, each of the nozzle holes H1 is formed so as to be located in a central part along the Y-axis direction on the ejection channel C1*e*. Further, the formation pitch along the X-axis direction in the nozzle holes H1 is arranged to be equal (to have an equal pitch) to the formation pitch along the X-axis direction in the ejection channels C1*e*. Although the details will be described later, it is arranged that the ink 9 supplied from the inside of the ejection channel C1*e* is ejected (jetted) from each of the nozzle holes H1 in such a nozzle column 410.

The other of the nozzle columns 410 similarly has a plurality of nozzle holes H2 formed in alignment with each other at predetermined intervals along the X-axis direction. Each of these nozzle holes H2 also penetrates the nozzle plate 411 along the thickness direction of the nozzle plate 411, and is communicated with the ejection channel C2*e* in the actuator plate 412 described later. Specifically, as shown in FIG. 6, each of the nozzle holes H2 is formed so as to be located in a central part along the Y-axis direction on the ejection channel C2*e*. Further, the formation pitch along the X-axis direction in the nozzle holes H2 is arranged to be equal to the formation pitch along the X-axis direction in the ejection channels C2*e*. Although the details will be described later, it is arranged that the ink 9 supplied from the inside of the ejection channel C2*e* is also ejected from each of the nozzle holes H2 in such a nozzle column 410.

It should be noted that such nozzle holes H1, H2 are each formed as a tapered through hole gradually decreasing in diameter toward the lower side.

(Actuator Plate 412)

The actuator plate 412 is a plate formed of a piezoelectric material such as lead zirconate titanate (PZT). The actuator plate 412 is formed by, for example, stacking two piezoelectric substrates different in polarization direction in the Z-axis direction on one another (a so-called chevron type). It is also possible to form the actuator plate 412 with a single piezoelectric substrate having the polarization direction set to one direction along the thickness direction (the Z-axis direction) (a so-called cantilever type). Further, as shown in FIG. 7, the actuator plate 412 is provided with two channel columns (channel columns 4121, 4122) each extending along the X-axis direction. These channel columns 4121, 4122 are arranged along the Y-axis direction at a predetermined distance.

In such an actuator plate 412, as shown in FIG. 7, an ejection area (jetting area) A1 of the ink 9 is disposed in a central part (the formation areas of the channel columns 4121, 4122) along the X-axis direction. On the other hand, in the actuator plate 412, a non-ejection area (a non-jetting area) A2 of the ink 9 is disposed in each of the both end parts (non-formation areas of the channel columns 4121, 4122) along the X-axis direction. The non-ejection areas A2 are located on the outer side along the X-axis direction with respect to the ejection area A1. It should be noted that the both end parts along the Y-axis direction in the actuator plate 412 each constitute a tail part 4120.

As shown in FIG. 6 and FIG. 7, the channel column 4121 described above has the plurality of channels C1 extending along the Y-axis direction. These channels C1 are arranged side by side so as to be parallel to each other at predetermined intervals along the X-axis direction. Each of the channels C1 is partitioned with drive walls Wd formed of a piezoelectric body (the actuator plate 412), and forms a groove section having a recessed shape in a cross-sectional view (see FIG. 6).

The channel column 4122 similarly has the plurality of channels C2 extending along the Y-axis direction. These channels C2 are arranged side by side so as to be parallel to each other at predetermined intervals along the X-axis direction. Each of the channels C2 is also partitioned with the drive walls Wd described above, and forms a groove section having a recessed shape in a cross-sectional view.

Here, as shown in FIG. 6 and FIG. 7, as the channels C1, there exist the ejection channels C1*e* for ejecting the ink 9, and dummy channels C1*d* not ejecting the ink 9. In the channel column 4121, the ejection channels C1*e* and the dummy channels C1*d* are alternately arranged along the X-axis direction. Each of the ejection channels C1*e* is communicated with the nozzle hole H1 in the nozzle plate 411 on the one hand, but each of the dummy channels C1*d* is not communicated with the nozzle hole H1, and is covered with the upper surface of the nozzle plate 411 from below on the other hand.

Similarly, as the channels C2, there exist the ejection channels C2*e* for ejecting the ink 9, and dummy channels C2*d* not ejecting the ink 9. In the channel column 4122, the ejection channels C2*e* and the dummy channels C2*d* are alternately arranged along the X-axis direction. Each of the ejection channels C2*e* is communicated with the nozzle hole H2 in the nozzle plate 411 on the one hand, but each of the dummy channels C2*d* is not communicated with the nozzle hole H2, and is covered with the upper surface of the nozzle plate 411 from below on the other hand.

Further, as shown in FIG. 7, the ejection channels C1*e* and the dummy channels C1*d* in the channels C1 and the ejection channels C2*e* and the dummy channels C2*d* in the channels C2 are arranged in a staggered manner. Therefore, in each of the inkjet heads 4 according to the present embodiment, the ejection channels C1*e* in the channels C1 and the ejection channels C2*e* in the channels C2 are arranged in a zigzag manner. It should be noted that as shown in FIG. 6, in the actuator plate 412, in the part corresponding to each of the dummy channels C1*d*, C2*d*, there is formed a shallow groove section Dd communicated with an outside end part extending along the Y-axis direction in the dummy channel C1*d*, C2*d*.

Here, as shown in FIG. 6, the drive electrode Ed extending along the Y-axis direction is disposed on each of the inside surfaces opposed to each other in the drive walls Wd described above. As the drive electrodes Ed, there exist common electrodes Edc disposed on the inner side surfaces facing the ejection channels C1*e*, C2*e*, and active electrodes Eda disposed on the inner side surfaces facing the dummy channels C1*d*, C2*d*. It should be noted that each of such drive electrodes Ed (the common electrodes Edc and the active electrodes Eda) is formed in the entire area in the depth direction (the Z-axis direction) on the inner side surface of the drive wall Wd.

The pair of common electrodes Edc opposed to each other in the same ejection channel C1*e* (or the same ejection channel C2*e*) are electrically connected to each other in a common terminal (not shown). Further, the pair of active electrodes Eda opposed to each other in the same dummy channel C1*d* (or the same dummy channel C2*d*) are electrically separated from each other. In contrast, the pair of active electrodes Eda opposed to each other via the ejection channel C1*e* (or the ejection channel C2*e*) are electrically connected to each other in an active terminal (not shown).

Here, as shown in FIG. 6, in the tail part 4120 described above, there is mounted a flexible printed circuit board 414 for electrically connecting the drive electrodes Ed and a control section (not shown) in the inkjet head 4 to each other. Interconnection patterns (not shown) provided to the flexible printed circuit board 414 are electrically connected to the common terminals and the active terminals described above. Thus, it is arranged that the drive voltage is applied to each of the drive electrodes Ed from the control section via the flexible printed circuit board 414.

(Cover Plate 413)

The cover plate 413 is disposed so as to close the channels C1, C2 (the channel columns 4121, 4122) in the actuator plate 412. Specifically, the cover plate 413 is bonded to the upper surface of the actuator plate 412, and has a plate-like structure.

As shown in FIG. 6, the cover plate 413 is provided with a pair of entrance side common ink chambers 431*a*, 432*a* and a pair of exit side common ink chambers 431*b*, 432*b*. Specifically, the entrance side common ink chamber 431*a* and the exit side common ink chamber 431*b* are each formed in an area corresponding to the channel column 4121 (the plurality of channels C1) in the actuator plate 412. Further, the entrance side common ink chamber 432*a* and the exit side common ink chamber 432*b* are each formed in an area corresponding to the channel column 4122 (the plurality of channels C2) in the actuator plate 412.

The entrance side common ink chamber 431*a* is formed in the vicinity of an inner end part along the Y-axis direction in each of the channels C1, and forms a groove section having a recessed shape. In areas corresponding respectively to the ejection channels C1*e* in the entrance side common ink chamber 431*a*, there are respectively formed supply slits Sa penetrating the cover plate 413 along the thickness direction (the Z-axis direction) of the cover plate 413. Similarly, the entrance side common ink chamber 432*a* is formed in the vicinity of an inner end part along the Y-axis direction in each of the channels C2, and forms a groove section having a recessed shape. In this entrance side common ink chamber 432*a*, the supply slit Sa described above is also formed in an area corresponding to each of the ejection channels C2*e*.

As shown in FIG. 6, the exit side common ink chamber 431*b* is formed in the vicinity of an outer end part along the Y-axis direction in each of the channels C1, and forms a groove section having a recessed shape. In areas corresponding respectively to the ejection channels C1*e* in the exit side common ink chamber 431*b*, there are respectively formed discharge slits Sb penetrating the cover plate 413 along the thickness direction of the cover plate 413. Similarly, the exit side common ink chamber 432*b* is formed in the vicinity of an outer end part along the Y-axis direction in each of the channels C2, and forms a groove section having a recessed shape. In this exit side common ink chamber 432*b*, the discharge slit Sb described above is also formed in an area corresponding to each of the ejection channels C2*e*.

In such a manner, the entrance side common ink chamber 431*a* and the exit side common ink chamber 431*b* are each communicated with the ejection channel C1*e* via the supply slit Sa and the discharge slit Sb on the one hand, but are not communicated with the dummy channels C1*d* on the other hand. Specifically, each of the dummy channels C1*d* is arranged to be closed by bottom parts of the entrance side common ink chamber 431*a* and the exit side common ink chamber 431*b*.

Similarly, the entrance side common ink chamber 432*a* and the exit side common ink chamber 432*b* are each communicated with the ejection channel C2*e* via the supply slit Sa and the discharge slit Sb on the one hand, but are not communicated with the dummy channels C2*d* on the other hand. Specifically, each of the dummy channels C2*d* is arranged to be closed by bottom parts of the entrance side common ink chamber 432*a* and the exit side common ink chamber 432*b*.

(Flow Channel Plate 41F)

FIG. 8 shows a planar configuration of the flow channel plate 41F shown in FIG. 2.

It should be noted that in FIG. 8, the plurality of nozzle holes H (H1, H2), the two nozzle columns 410, the plurality of channels C (C1, C2) and the channel columns (4121, 4122) are represented by the dotted lines in order to make the positional relationship between the nozzle plate 411 and the flow channel plate 41F easy to understand.

The flow channel plate 41F has flow channels 41FP of the ink 9 to be supplied to the plurality of channels C as shown in, for example, FIG. 8. The flow channels 41FP are penetrating grooves for transmitting the ink 9, and extend in the same direction (the X-axis direction) as the extending direction of the channel columns 4121, 4122.

In particular, the flow channels 41FP have, for example, a plurality of introduction flow channels FP1 and a plurality of discharge flow channels FP2 for transmitting the ink 9. Specifically, the flow channels 41FP include, for example, the introduction flow channel FP1*a* and the discharge flow channel FP2*a* disposed at positions corresponding to the channel column 4121, and the introduction flow channel FP1*b* and the discharge flow channel FP2*b* disposed at positions corresponding to the channel column 4122. This is because even if pressure waves are generated due to the jet of the ink 9 in the plurality of channels C1 included in the channel column 4121, it becomes difficult for the pressure waves to propagate to the plurality of channels C2 included in the channel column 4122. Thus, the ink 9 is stably jetted from the plurality of nozzle holes H. Further, this is because the total amount (the circulation amount) of the ink 9 in the flow channels 41FP becomes large. Thus, even the ink 9 high in viscosity is sufficiently and stably circulated.

The introduction flow channel FP1*a* and the discharge flow channel FP2*a* are disposed so as to overlap one of the channel column 4121. The introduction flow channel FP1*a* is an introduction opening for introducing the ink 9 into the plurality of channels C1, and at the same time, the discharge flow channel FP2*a* is a discharge opening for discharging the ink 9 from the plurality of channels C1. Therefore, the ink 9 is introduced into the plurality of channels C1 via the introduction flow channel FP1*a*, and is then discharged from the plurality of channels C1 via the discharge flow channel FP2*a*.

Since one of the nozzle columns 410 is disposed between the introduction flow channel FP1*a* and the discharge flow channel FP2*a*, the introduction flow channel FP1*a* and the discharge flow channel FP2*a* are separated from each other in the Y-axis direction via the nozzle column 410. The introduction flow channel FP1*a* is disposed, for example, on the inner side of the discharge flow channel FP2*a* in the Y-axis direction.

The introduction flow channel FP1*b* and the discharge flow channel FP2*b* are disposed so as to overlap the other of the channel column 4122. The introduction flow channel FP1*b* is an introduction opening for introducing the ink 9 into the plurality of channels C2, and at the same time, the discharge flow channel FP2*b* is a discharge opening for discharging the ink 9 from the plurality of channels C2. Therefore, the ink 9 is introduced into the plurality of channels C2 via the introduction flow channel FP1*b*, and is then discharged from the plurality of channels C2 via the discharge flow channel FP2*b*.

Since the other of the nozzle columns 410 is disposed between the introduction flow channel FP1*b* and the discharge flow channel FP2*b*, the introduction flow channel FP1*b* and the discharge flow channel FP2*b* are separated from each other in the Y-axis direction via the nozzle column 410. The introduction flow channel FP1*b* is disposed, for example, on the inner side of the discharge flow channel FP2*b* in the Y-axis direction.

To the flow channel 41FP provided to such a flow channel plate 41F, there are connected the introduction port 52*a* and the discharge port 52*b*. Specifically, the introduction port 52*a* is connected to the introduction flow channels FP1*a*, FP1*b*, and the discharge port 51*b* is connected to the discharge flow channels FP2*a*, FP2*b*.

[Basic Operation of Printer 1]

In the printer 1, a recording operation (a printing operation) of images, characters, and so on to the recording paper P is performed in the following manner. It should be noted that as an initial state, it is assumed that the four types of ink tanks 3 (3Y, 3M, 3C, and 3B) shown in FIG. 1 are sufficiently filled with the ink 9 of the corresponding colors (the four colors), respectively. Further, there is achieved the state in which the inkjet heads 4 are filled with the ink 9 in the ink tanks 3 via the circulation mechanism 5, respectively.

In such an initial state, when operating the printer 1, the grit rollers 21 in the carrying mechanisms 2*a*, 2*b* rotate to thereby carry the recording paper P along the carrying direction d (the X-axis direction) between the grit rollers 21 and the pinch rollers 22. Further, at the same time as such a carrying operation, the drive motor 633 in the drive mechanism 63 respectively rotates the pulleys 631*a*, 631*b* to thereby operate the endless belt 632. Thus, the carriage 62 reciprocates along the width direction (the Y-axis direction) of the recording paper P while being guided by the guide rails 61*a*, 61*b*. Then, on this occasion, the four colors of ink 9 are appropriately ejected on the recording paper P by the respective inkjet heads 4 (4Y, 4M, 4C, and 4B) to thereby perform the recording operation of images, characters, and so on to the recording paper P.

[Detailed Operation in Inkjet Heads 4]

Then, the detailed operation (the jet operation of the ink 9) in the inkjet heads 4 will be described with reference to FIG. 1, FIG. 6 and FIG. 7. Specifically, in the inkjet heads 4 according to the present embodiment, the jet operation of the ink 9 using a shear mode is performed in the following manner.

Firstly, when the reciprocation of the carriage 62 (see FIG. 1) described above is started, the drive circuit applies the drive voltage to the drive electrodes Ed in the inkjet head 4 (the head chip 41). Specifically, the drive circuit applies the drive voltage to the drive electrodes Ed disposed on the pair of drive walls Wd partitioning the ejection channel C1*e*. Thus, the pair of drive walls Wd each deform (see FIG. 6) so as to protrude toward the dummy channel C1*d* adjacent to the ejection channel C1*e*.

Here, as described above, in the actuator plate 412, the polarization direction differs along the thickness direction (the two piezoelectric substrates described above are stacked on one another), and at the same time, the drive electrodes Ed are formed in the entire area in the depth direction on the inner side surface in each of the drive walls Wd. Therefore, by applying the drive voltage using the drive circuit described above, it results that the drive wall Wd makes a flexion deformation to have a V shape centered on the intermediate position in the depth direction in the drive wall Wd. Further, due to such a flexion deformation of the drive wall Wd, the ejection channel C1*e*, C2*e* deforms as if the ejection channel C1*e*, C2*e* bulges.

In the case in which the configuration of the actuator plate 412 is not the chevron type but is the cantilever type described above, the drive wall Wd makes the flexion deformation to have the V shape in the following manner. That is, in the case of the cantilever type, since it results that the drive electrode Ed is attached by the oblique evaporation to an upper half in the depth direction, by the drive force exerted only on the part provided with the drive electrode Ed, the drive wall Wd makes the flexion deformation (in the end part in the depth direction of the drive electrode Ed). As a result, even in this case, since the drive wall Wd makes the flexion deformation to have the V shape, it results that the ejection channel C1*e*, C2*e* deforms as if the ejection channel C1*e*, C2*e* bulges.

As described above, due to the flexion deformation caused by a piezoelectric thickness-shear effect in the pair of drive walls Wd, the capacity of the ejection channel C1*e* increases. Further, by increasing the capacity of the ejection channel C1*e*, the ink 9 in an ink introduction hole in the cover plate 413 described above is induced into the ejection channel C1*e* via the slit as a result (see FIG. 6).

Subsequently, the ink 9 having been induced into the ejection channel C1*e* in such a manner turns to a pressure wave to propagate to the inside of the ejection channel C1*e*. Then, the drive voltage to be applied to the drive electrodes Ed becomes 0 (zero) V at the timing at which the pressure wave has reached the nozzle hole H1 of the nozzle plate 411. Thus, the drive walls are restored from the state of the flexion deformation described above, and as a result, the capacity of the ejection channel C1*e* having once increased is restored again.

When the capacity of the ejection channel C1*e* is restored in such a manner, the internal pressure of the ejection channel C1*e* increases, and the ink 9 in the ejection channel C1*e* is pressurized. As a result, the ink 9 having a droplet shape is ejected toward the outside (toward the recording paper P) through the nozzle hole H1. The jet operation (the ejection operation) of the ink 9 in the inkjet head 4 is performed in such a manner, and as a result, the recording operation of images, characters, and so on to the recording paper P is performed.

[Functions and Advantages]

Then, the functions and the advantages in the inkjet head 4 and the printer 1 according to the present embodiment will be described in detail in comparison with a comparative example.

Comparative Example

Figure 9:
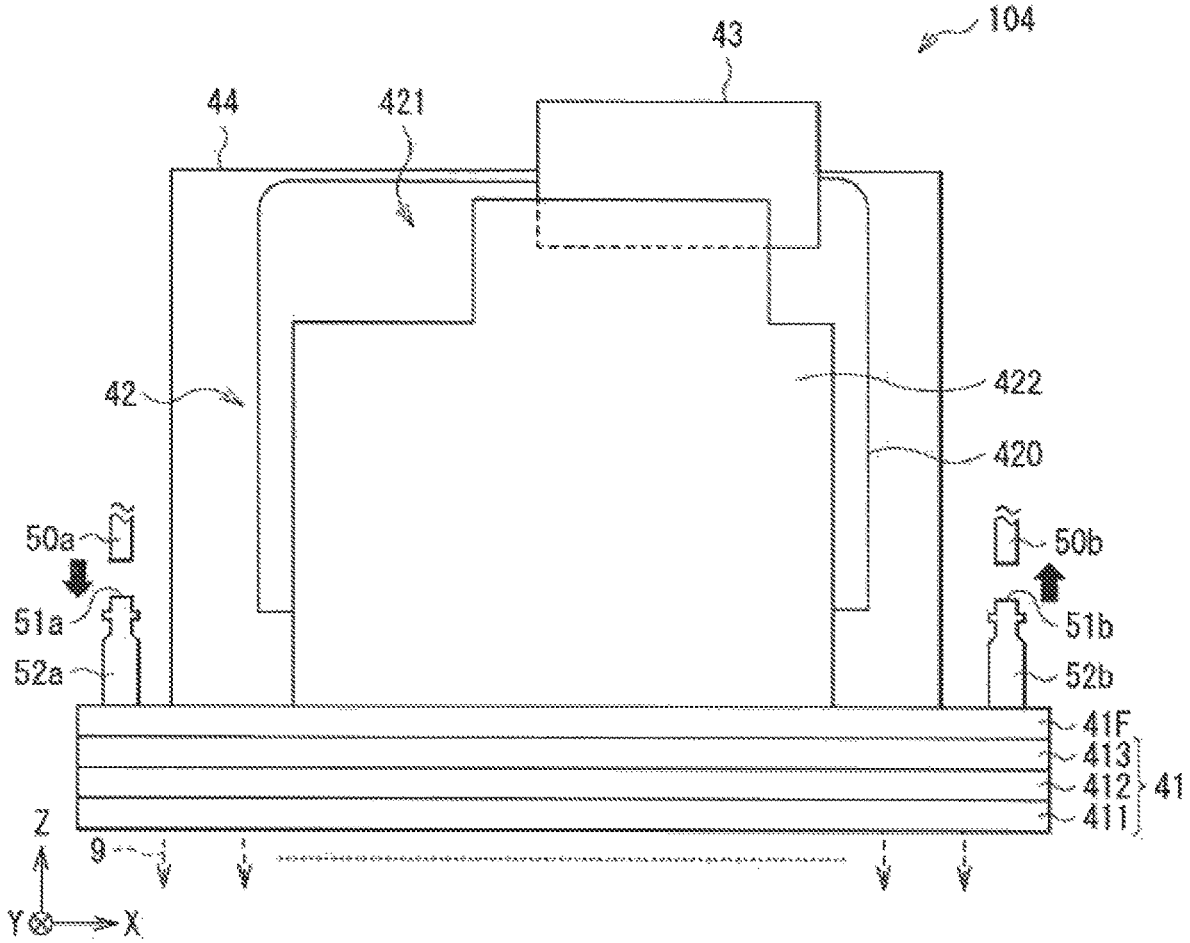
FIG. 9 is a schematic side view showing a configuration example of a liquid jet head related to a comparative example.

FIG. 9 is a side view (a Z-X side view) schematically showing a configuration example of an inkjet head (an inkjet head 104) related to the comparative example. The inkjet head 104 of the comparative example is not provided with the connection section cover (the connection section cover 45 shown in FIG. 2), and the connection section 43 is exposed outside the cover 44. As shown in the drawing, the ink easily adheres to the connection section 43 always set in the exposed state. If the ink adheres to the connection section 43, there is a possibility that an electrical failure such as short-circuit occurs in the connection section 43 and the electronic control section 42 to damage the reliability.

Present Embodiment

In contrast, in the inkjet head 4 according to the present embodiment, since the connection section cover 45 for covering the connection section 43 is provided, the adhesion of the ink 9 to the connection section 43 is prevented. Therefore, the electrical failure such as short-circuit due to the adhesion of the ink 9 to the connection section 43 is prevented from occurring. Therefore, it becomes possible to enhance the reliability.

Further, since the connection section cover 45 pivots about the hinge 46, it is possible to easily switch between the protection state and the exposure state. Thus, it is possible to easily set the connection section cover 45 to the protection state by pivoting the connection section cover 45 after setting the connection section cover 45 to the exposure state to connect the electric cable 47 to the connection section 43. Therefore, it is possible to connect the electric cable 47 to the connection section 43 without being hindered by the connection section cover 43.

As described above, in the inkjet head 4 according to the present embodiment, since it is arranged to provide the connection section cover 45, it becomes possible to prevent the adhesion of the ink 9 to the connection section 43 and the electric failure due to the adhesion from occurring to thereby enhance the reliability.

Further, since it is arranged that the protection state and the exposure state can easily be switched from each other in the connection section cover 45, it is possible to connect the electric cable 47 to the connection section 43 without being hindered by the connection section cover 45.

Further, since it is possible to set the connection section cover 45 to the exposure state while keeping the connection section cover 45 connected to the cover 44 due to the hinge 46, it is possible to prevent the correction section cover 45 from being lost.

In addition, since the front panel 452 of the connection section cover 45 is provided with the barb part 452K, it is also possible to prevent the ink 9 from adhering to the connection section 43 from obliquely below via the gap S through which the electric cable 47 passes. Therefore, it is possible to more effectively prevent the ink 9 from adhering to the connection section 43.

Further, since the inkjet head 4 is provided with the holding structure 441 of the electric cable 47, even if the force is applied to the electric cable 47, the movement in the upward direction of the electric cable 47 in the gap S is prevented. Therefore, it becomes possible to prevent the connecting section 43 from being unintentionally exposed due to the contact of the electric cable 47 with the connection section cover 45. By providing the holding structure 441 with the hook-like shape, it is possible to prevent the electric cable 47 from moving upward with a simple configuration.

Modified Examples

The present disclosure is hereinabove described using the embodiment, but the disclosure is not limited to the embodiment, and a variety of modifications can be adopted.

For example, in the embodiment described above, the description is presented specifically citing the configuration examples (the shapes, the arrangements, the number and so on) of each of the members in the printer, the inkjet head and the head chip, but what is described in the above embodiment is not a limitation, and it is possible to adopt other shapes, arrangements, numbers and so on. Further, the values or the ranges, the magnitude relation and so on of a variety of parameters described in the above embodiment are not limited to those described in the above embodiment, but can also be other values or ranges, other magnitude relation and so on.

Specifically, the shape, the configuration and so on of the connection section cover 45 described in the above embodiment are not limited to those described in the above embodiment and so on, but can also be other shapes, configurations and so on. For example, although in the embodiment described above, there is described the case of making the state transition between the protection state and the exposure state of the connection section cover 45 using the hinge 46, it is also possible to make the state transition of the connection section cover 45 using other methods. For example, it is also possible to provide the connection section cover 45 of a removable type so that the connection section cover 45 can be detached from the cover 44. Alternatively, it is also possible to arrange that the state transition between the protection state and the exposure state is made by sliding the connection section cover 45.

Further, although in the embodiment described above, there is described the case in which the connection section cover 45 in the protection state covers all of the surfaces of the connection section 43 exposed from the cover 44, the lateral side of the connection section 43 can be exposed from the connection section cover 45.

Further, for example, in the embodiment described above, the cross-sectional shape of each of the nozzle holes H1 is not limited to the circular shape as described in the above embodiment, but can also be, for example, an elliptical shape, a polygonal shape such as a triangular shape, or a star shape.

Further, in the embodiment described above, the example of the so-called side-shoot type inkjet head for ejecting the ink 9 from the central part in the extending direction of the ejection channels C1*e*, C2*e* is described, but the example is not a limitation. Specifically, it is also possible to apply the present disclosure to a so-called edge-shoot type inkjet head for ejecting the ink 9 along the extending direction of the ejection channels C1*e*, C2*e*.

Further, for example, in the embodiment described above, the description is presented citing the inkjet head 4 having the two-column type nozzle columns 410, but this example is not a limitation. Specifically, for example, it is also possible to adopt an inkjet head of a single column type (having a single nozzle column), or an inkjet head of a multi-column type (having three or more nozzle columns) with three or more columns.

Further, for example, in the embodiment described above, there is described the case in which the ejection channels C1*e*, C2*e* and the dummy channels C1*d*, C2*d* each extend along the Y-axis direction in the actuator plate 412, but this example is not a limitation. For example, it is also possible to arrange that the ejection channels and the dummy channels each extend along an oblique direction to the Y-axis direction in the actuator plate 412.

Further, in the embodiment described above and so on, the description is presented citing the circulation type inkjet head 4 for using the ink 9 while circulating the ink 9 mainly between the ink tank 3 and the inkjet head 4 as an example, but this example is not a limitation. Specifically, it is also possible to apply the present disclosure to a non-circulation type inkjet head using the ink 9 without circulating the ink 9.

Further, in the above embodiment, the description is presented citing the printer 1 (the inkjet printer) as a specific example of the "liquid jet recording device" in the present disclosure, but this example is not a limitation, and it is also possible to apply the present disclosure to other devices than the inkjet printer. In other words, it is also possible to arrange that the "liquid jet section" (the head chip 41 and the flow channel plate 41F) and the "liquid jet head" (the inkjet head 4) of the present disclosure are applied to other devices than the inkjet printer. Specifically, for example, it is also possible to arrange that the "head chip" and the "liquid jet head" of the present disclosure are applied to a device such as a facsimile or an on-demand printer.

In addition, it is also possible to apply the variety of examples described hereinabove in arbitrary combination.

It should be noted that the advantages described in the specification are illustrative only but are not a limitation, and other advantages can also be provided.

The present disclosure may be embodied as described below.

<1>

A liquid jet head comprising a liquid jet section from which liquid is jetted; an electronic control section electrically connected to the liquid jet section; a main protective member adapted to cover a periphery of the electronic control section; a connection section attached to the electronic control section and adapted to electrically connect an outside of the liquid jet head and the electronic control section to each other; and a connection section protective member configured so as to make a state transition between a protection state of covering the connection section and an exposure state of exposing the connection section.

<2>

The liquid jet head according to <1>, further comprising a hinge adapted to connect the main protective member and the connection section protective member to each other, wherein the connection section protective member is disposed so as to pivot about the hinge.

<3>

The liquid jet head according to <1> or <2>, wherein the connection section protective member includes a back plate a lower end of which has contact with the main protective member, a front plate opposed to the back plate across the connection section, and disposed so that a lower end of the front plate has a gap with the main protective member, and an upper plate adapted to connect an upper end of the front plate and an upper end of the back plate to each other.

<4>

The liquid jet head according to <3>, wherein a barb part tilted toward the connection section is disposed at the lower end of the front plate.

<5>

The liquid jet head according to <3> or <4>, further comprising a holding structure adapted to limit a movement in the gap of an electric cable adapted to electrically connect the connection section and the outside to each other.

<6>

The liquid jet head according to <5>, wherein the holding structure is provided to the main protective member.

<7>

The liquid jet head according to <5> or <6>, wherein the holding structure has a hook-like shape.

<8>

The liquid jet head according to any one of <1> to <7>, further comprising an introduction opening adapted to introduce the liquid into the liquid jet section, wherein the introduction opening is disposed at a lower level than the connection section.

<9> liquid jet recording device comprising the liquid jet head according to any one of <1> to <8>.

What is claimed is:

1. A liquid jet head comprising:

a liquid jet section from which liquid is jetted;

an electronic control section electrically connected to the liquid jet section;

a main protective member adapted to cover a periphery of the electronic control section;

a connection section attached to the electronic control section and adapted to electrically connect an outside of the liquid jet head and the electronic control section to each other;

a connection section protective member configured so as to make a state transition between a protection state of covering the connection section and an exposure state of exposing the connection section, wherein the connection section protective member includes:

a back plate a lower end of which has contact with the main protective member, a front plate opposed to the back plate across the connection section, and disposed so that a lower end of the front plate has a gap with the main protective member, and an upper plate adapted to connect an upper end of the front plate and an upper end of the back plate to each other; and wherein an electric cable adapted to electrically connect the connection section and the outside to each other is adapted to be inserted in the gap.

2. The liquid jet head according to claim 1, further comprising:

a hinge adapted to connect the main protective member and the connection section protective member to each other, wherein the connection section protective member is disposed so as to pivot about the hinge.

3. The liquid jet head according to claim 1, wherein a barb part tilted toward the connection section is disposed at the lower end of the front plate.

4. The liquid jet head according to claim 1, further comprising a holding structure adapted to limit a movement in the gap of the electric cable adapted to electrically connect the connection section and the outside to each other.

5. The liquid jet head according to claim 4, wherein the holding structure is provided to the main protective member.

6. The liquid jet head according to claim 4, wherein the holding structure has a hook-like shape.

7. The liquid jet head according to claim 1, further comprising an introduction opening adapted to introduce the liquid into the liquid jet section, wherein the introduction opening is disposed at a lower level than the connection section.

8. A liquid jet recording device comprising the liquid jet head according to claim 1.

* * * * *